US010714870B1

(12) United States Patent
Yu

(10) Patent No.: US 10,714,870 B1
(45) Date of Patent: Jul. 14, 2020

(54) ELECTRICAL SOCKET

(71) Applicant: NINGBO WELL ELECTRIC APPLIANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 0 days.

(21) Appl. No.: 16/446,618

(22) Filed: Jun. 20, 2019

(30) Foreign Application Priority Data

Apr. 30, 2019 (CN) ..... 2019 1 0360554
Apr. 30, 2019 (CN) ..... 2019 2 0616376 U

(51) Int. Cl.
*H01R 13/639* (2006.01)
*H01R 103/00* (2006.01)
*H01R 24/22* (2011.01)

(52) U.S. Cl.
CPC ..... *H01R 13/639* (2013.01); *H01R 24/22* (2013.01); *H01R 2103/00* (2013.01)

(58) Field of Classification Search
CPC ..... H01R 13/506; H01R 13/62933; H01R 13/62938; H01R 25/006; H01R 25/02; H01R 25/04; H01R 39/64; H01R 13/639
See application file for complete search history.

(56) References Cited

U.S. PATENT DOCUMENTS 5,893,772 A * 4/1999 Carmo ..... H01R 13/639 439/346
6,229,107 B1 * 5/2001 Flint ..... H01R 13/652 200/51.09
6,918,780 B1 * 7/2005 Yang ..... H01R 13/639 439/346
7,172,451 B1 * 2/2007 Ratzlaff ..... H01R 13/639 439/106
7,182,615 B1 * 2/2007 Liu ..... H01R 13/113 439/263
7,442,891 B2 * 10/2008 Chen ..... H01R 13/6275 200/318
D602,434 S * 10/2009 Mancari ..... D13/139.1
8,545,251 B2 * 10/2013 Gordon ..... H01R 13/6395 439/346
8,840,418 B2 * 9/2014 Chien ..... H01R 13/6392 439/270
9,362,672 B1 * 6/2016 Sun ..... H01R 13/639
9,496,648 B1 * 11/2016 Jian ..... H01R 24/22
9,929,510 B2 * 3/2018 Vass ..... H01R 13/6395
(Continued)

*Primary Examiner* — Abdullah A Riyami
*Assistant Examiner* — Nader J Alhawamdeh

(57) ABSTRACT

The present disclosure discloses an electrical socket to receive an electrical plug having a plurality of contact blades. The electrical socket includes a main body having a plurality of socket openings; a cover member disposed in the main body and being detachable from the main body; a rotary member connected to the main body, wherein an end of the rotary member inserts into the main body, wherein the cover member is configured for limiting the rotary member to the main body, the rotary member is able to rotate relative to the main body to make one of the plurality of contact blades inserted in one of the plurality of socket openings prevent sliding out from the one of the plurality of socket openings.

11 Claims, 8 Drawing Sheets

(56) References Cited

U.S. PATENT DOCUMENTS

| | | | | |
|---|---|---|---|---|
| 10,483,694 | B2 * | 11/2019 | Crowder | H01R 13/447 |
| 2014/0057477 | A1 * | 2/2014 | Raptis | H01R 13/639<br>439/346 |
| 2014/0120740 | A1 * | 5/2014 | Shum | H01R 24/78<br>439/13 |
| 2015/0236455 | A1 * | 8/2015 | Lin | H01R 13/703<br>439/188 |
| 2015/0357759 | A1 * | 12/2015 | Liu | H01R 13/6335<br>439/152 |
| 2018/0034220 | A1 * | 2/2018 | Forti | H02G 3/18 |

* cited by examiner

ELECTRICAL SOCKET

CROSS-REFERENCE TO RELATED APPLICATIONS

This application claims all benefits accruing under 35 U.S.C. § 119 from China Patent Application Nos. 201910360554.5, filed on Apr. 30, 2019, and 201920616376.3, filed on Apr. 30, 2019, in the State Intellectual Property Office of China, the content of which is hereby incorporated by reference.

TECHNICAL FIELD

The present disclosure relates to an electrical socket.

BACKGROUND

An electrical socket, also known as a power outlet or a switch socket, includes at least one socket opening for receiving an electrical plug having a plurality of contact blades.

However, when the electrical socket and the electrical plug are mated in use, the electrical plug can detach easily from the electrical socket, which may affect normal use of electrical equipment, shutting off power and causing damage to the electrical equipment or a safety accident.

SUMMARY

In order to provide an electrical socket with a good locking feature, an embodiment of the present disclosure includes an electrical socket to receive an electrical plug having a plurality of contact blades. The electrical socket includes a main body having a plurality of socket openings, a cover member disposed in the main body and being detachable from the main body, and a rotary member connected to the main body. An end of the rotary member inserts into the main body, wherein the cover member is configured for limiting the rotary member to the main body, the rotary member is able to rotate relative to the main body to make one of the plurality of contact blades inserted in one of the plurality of socket openings prevent sliding out from the one of the plurality of socket openings.

Furthermore, a plurality of conductor pieces corresponding to the plurality of socket openings are disposed in the main body, and when the rotary member is rotated, the end of the rotary member abuts the one of the plurality of conductor pieces in order to make one of the plurality of contact blades inserted in the one of the plurality of socket openings prevent sliding out from the one of the plurality of conductor pieces.

Furthermore, the one of the plurality of conductor pieces includes an opening towards the rotary member and an extending piece connected to the one of the plurality of conductor pieces and disposed in the opening, a part of the extending piece has a concave shape.

Furthermore, at least one first groove is disposed on a surface of the extending piece which is far away from the rotary member.

Furthermore, the cover member includes an inserting part configured for inserting into and being mated with the main body.

Furthermore, a flange is disposed on one end of the inserting part and configured for engaging the inserting part to the main body.

Furthermore, the end of the inserting part further includes a second groove configured for connecting the inserting part to the main body.

Furthermore, the main body includes a first through hole communicating with the one of the plurality of socket openings, and the cover member includes a second through hole communicating with the first through hole to form a passage.

Furthermore, a diameter of the first through hole is larger than a diameter of the second through hole.

Furthermore, the rotary member includes a shaft and a handle connected with the shaft, an end of the shaft inserts to the main body through the passage and abuts the one of the plurality of conductor pieces.

Furthermore, the end of the shaft includes a threaded portion for connecting to the main body, and an inner wall of the first through hole is threaded for coupling with the threaded portion.

Furthermore, the main body includes three socket openings.

The electrical socket of the present embodiment has following advantages. The rotary member is connected to the main body by the cover member and able to rotate relative to the main body to make one of the plurality of contact blades inserted in one of the plurality of socket openings prevent sliding out from the one of the plurality of socket openings. So that the electrical plug can be stably locked by the electrical socket. At the same time, the electrical plug can be electrically connected with the electrical socket. The operation thereof is simple and the electrical plug is not easily detached from the electrical socket.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
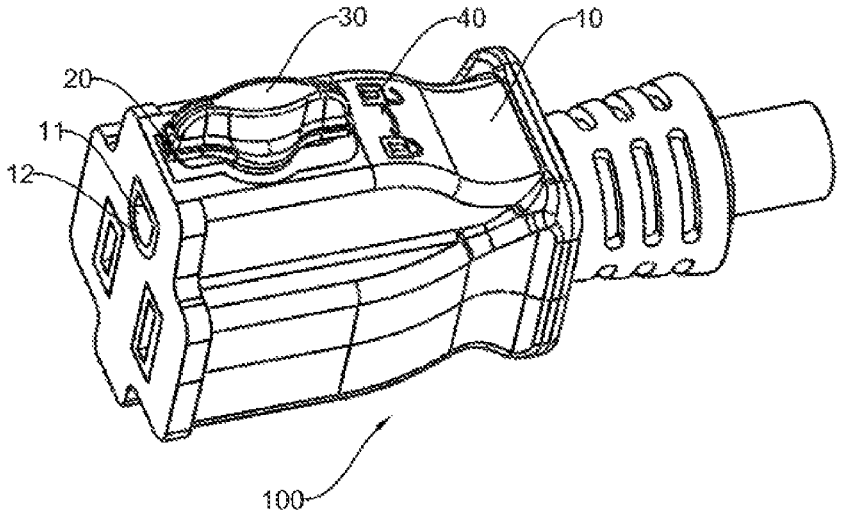
FIG. 1 is a perspective view of an electrical socket according to an embodiment of the present disclosure.
Figure 2:
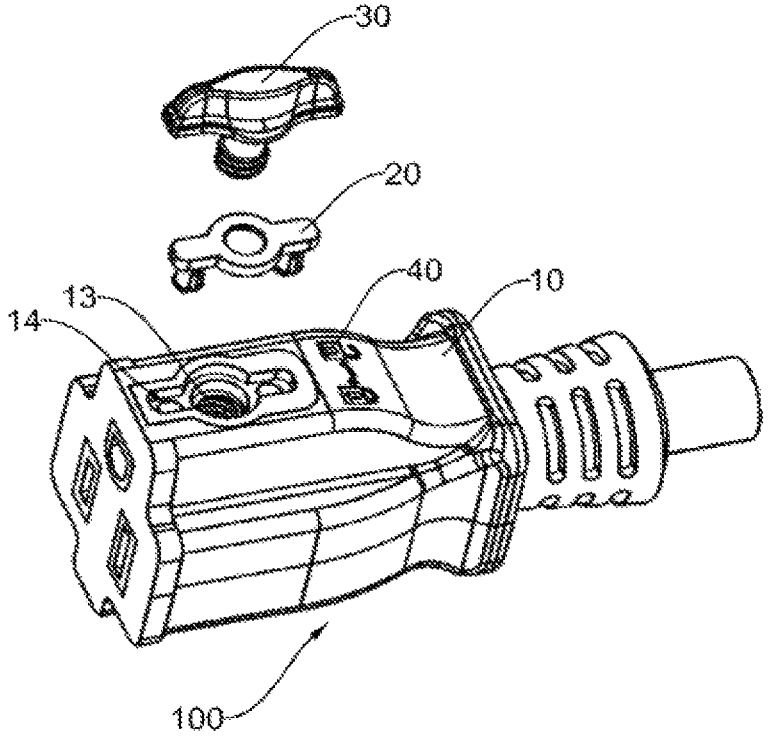
FIG. 2 is an exploded view of the electrical socket of FIG. 1.
Figure 3:
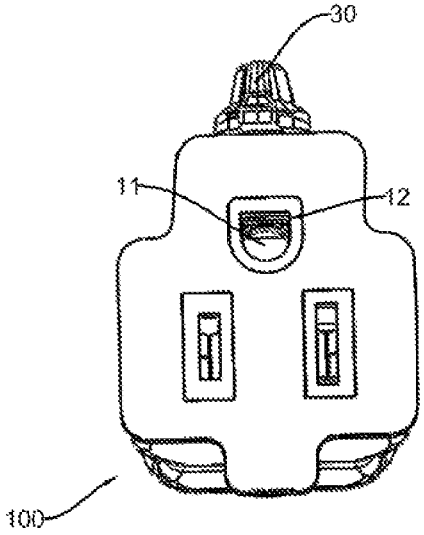
FIG. 3 is another perspective view of the electrical socket of FIG. 1.

Referring to FIGS. 1-3, an embodiment of the present disclosure includes an electrical socket 100, which is mated with an electrical plug having a plurality of contact blades. The electrical socket 100 can be configured for preventing the electrical plug from sliding out. The electrical socket 100 can be electrically connected with the electrical plug.

Referring to FIG. 2, the electrical socket 100 includes a main body 10, a cover member 20, and a rotary member 30. The main body 10 includes a plurality of socket openings 11 configured for receiving the electrical plug, resulting in the electrical socket 100 can be electrically connected with the electrical plug. The cover member 20 can be removably attached to the main body 10. The cover member 20 can be disposed in a cavity 14 on the main body 10. The cover member 20 can be disposed between the main body 10 and the rotary member 30. The cover member 20 is configured for securing the rotary member 30 to the main body 10 to prevent the rotary member 30 from being removed from the main body 10. The rotary member 30 can be connected to the main body 10. As shown in FIG. 1, an end of the rotary member 30 extends into the main body 10. The rotary member 30 is able to rotate into the main body 10 to prevent one of the plurality of contact blades inserted in one of the plurality of socket openings 11 from sliding out from the one of the plurality of socket openings 11.

One or more conductor pieces 12 corresponding to the plurality of socket openings 11 are disposed in the main body 10. In one embodiment, the main body 10 includes three socket openings 11. It can be understood that the number of socket openings 11 is not limited to three. The structure of each of the plurality of socket openings 11 and corresponding conductor pieces 12 is not limited and can be any shape and different from each other.

The conductor pieces 12 can be received in the main body 10. Ends of the plurality of conductor pieces 12 can abut the plurality of socket openings 11. A receiving space can be formed in the conductor piece 12 so that the electrical plug can insert into the one or more receiving spaces, thereby achieving electrical connection between the electrical plug and the electrical socket 100.

Figure 4:
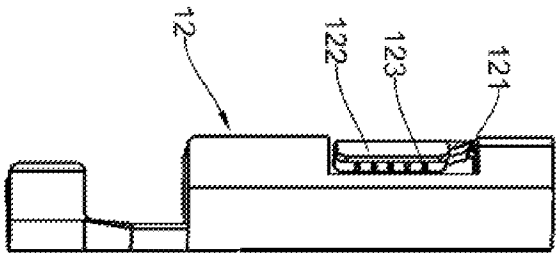
FIG. 4 is a perspective view of one of a plurality of conductor pieces of the electrical socket of FIG. 1.
Figure 5:
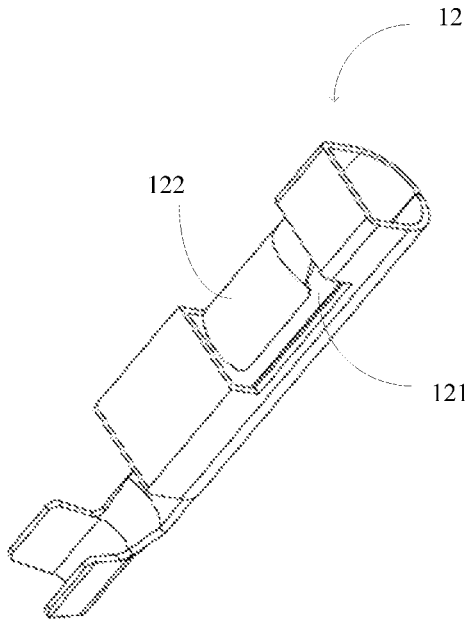
FIG. 5 is another perspective view of one of a plurality of conductor pieces of FIG. 5.
Figure 6:
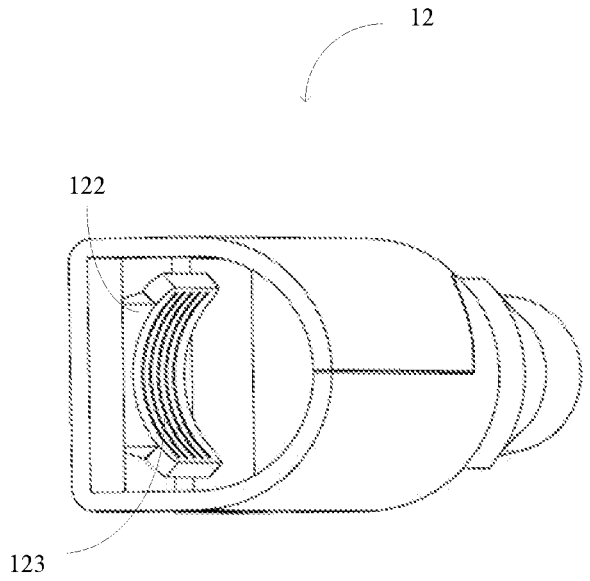
FIG. 6 is another perspective view of one of a plurality of conductor pieces of FIG. 5.

As shown in FIGS. 4-6, one of the plurality of conductor pieces 12 includes a structural body having an opening 121 facing to the rotary member 30 and an extending piece 122 connected to the structural body and extending over or disposed within the opening 121. A part of the extending piece 122 has a concave shape. As shown in FIG. 5, one end of the extending piece 122 is connected to the edge of the opening 121, and the other end of the extending piece 122 is free. Said differently, the extending piece 122 is cantilevered over the opening 121. When the rotary member 30 is rotated into the main body 10, the free end of the rotary member 30 abuts a surface of the extending piece 122 of the conductor piece 12 to prevent the contact blade inserted in the socket opening 11 from sliding out from the conductor piece 12. The conductor piece 12 can be connected to ground.

Referring to FIG. 6, at least one first groove 123 is disposed on a surface of the extending piece 122 away from the rotary member 30. The first groove 123 is configured for increasing damping between the extending piece 122 and the contact blade when the contact blade abuts and/or deflects the extending piece as the electrical plug is inserted into the one or more conductor pieces 12, so as to effectively prevent the contact blade from being loose.

It can be understood that the extending piece 122 can be deformed by the end of the rotary member 30 when the rotary member 30 is rotated into the main body 10. The extending piece 122 abuts the contact blade inserted in the conductor piece 12. The end of the rotary member 30 forces the extending piece 122 against the contact blade as the rotary member rotates into the main body 10. When the rotary member 30 rotates back and moves away from the main body 10, the force exerted against the extending piece decreases, and accordingly, the force of the extending piece 122 against the contact blade and the extending piece 122 can return (e.g., elastically) to an initial state. The initial state can be the state when the contact blade is not inserted in the conductor pieces 12. In addition, the conductor pieces 12 and the extending piece 122 can be made of a copper material.

Referring to FIG. 2, the main body 10 can include a first through hole 13 communicating with the one of the plurality of socket openings 11. The end of the rotary member 30 will penetrate the first through hole 13 until abutting the extending piece 122. Furthermore, a cavity 14 can be defined on a surface of the main body 10 and configured for receiving the cover member 20. The cavity 14 can be a same shape of the cover member 20.

Figure 7:
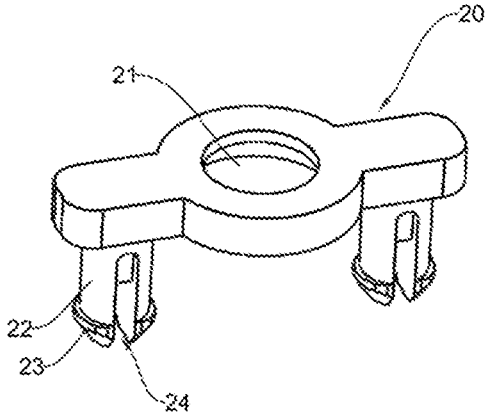
FIG. 7 is a perspective view of a cover member of the electrical socket of FIG. 1.

Referring to FIG. 7, the cover member 20 can include a second through hole 21 communicating with the first through hole 13 to form a passage. A diameter of the first through hole 13 can be larger than a diameter of the second through hole 21.

The cover member 20 can include an inserting part 22 configured for inserting into and being mated with the main body 10. That is, the inside of the main body 10 is compatible with the configuration of the inserting part 22, so that the inserting part 22 can be inserted into the socket body 10 to detachably mount the cover member 20 on the main body 10.

In this embodiment, two inserting parts 22 are formed on the cover member 20 and oppositely disposed on the cover member 20. The two inserting parts 22 are symmetrical relative to the second through hole 21. When the cover member 20 is pressed into the main body 10 in a pressing manner, the two inserting parts 22 will insert into the main body 10 to enable the cover member 20 to be evenly stressed, thereby reducing the resistance during installation of the cover member 20 into the main body 10. It should be noted that the number of the inserting parts 22 formed on the cover member 20 is not limited to the number shown in FIG. 2, and one skilled in the art may design different number of inserting parts 22 according to needs.

A flange 23 can be disposed on one end of the inserting part 22 and configured for engaging the inserting part 22 to the main body 10. The flange 23 can be located on the end of the inserting part 22 which is far away from the second through hole 21. Another protrusion can be formed in the main body 10 and coupled with the flange 23. When the inserting part 22 is inserted to the main body 10, the flange 23 can be coupled with the protrusion in the main body 10, thereby the cover member 20 can be detachably mounted on the main body 10. It should be noted that, the flange 23 can be arc-shaped, columnar-shaped, or block-shaped.

The end of the inserting part 22 can further include a second groove 24 configured for connecting the inserting part 22 to the main body 10. The second groove 24 and the flange 23 will cooperate and make the inserting part 22 detachably connect to the main body 10. When installing the cover member 20, the inserting part 22 will insert into the main body 10, the end of the inserting part 22 will deform and size of the second groove 24 will decrease. That is, the second groove 24 will make the installation of the cover member 20 easier. After the inserting part 22 is inserted into the main body 10, the second groove 24 will gradually return to an initial state. Thereby the inserting part 22 will be mounted on the main body 10. A depth of the second groove 24 can be at least one-half of a height of the inserting part 22, so as to reduce the external force required when mounting the inserting part 22.

Figure 8:
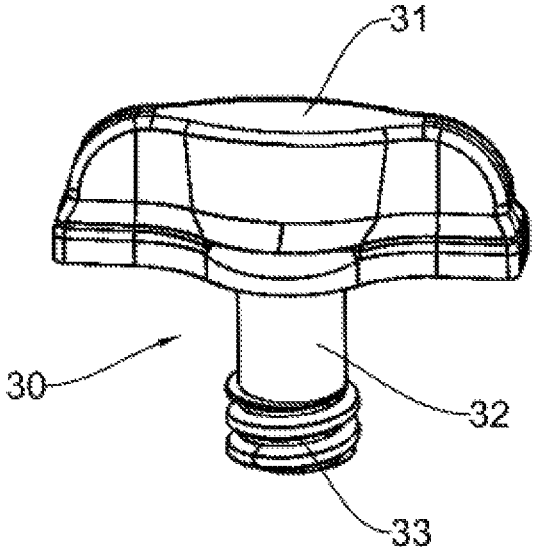
FIG. 8 is a perspective view of a rotary member of the electrical socket of FIG. 1.

Referring to FIG. 8, the rotary member 30 can include a shaft 32 and a handle 31 connected with a first end of the shaft 32. A second end of the shaft 32 inserts to the main body 10 through the passage and abuts the one of the plurality of conductor pieces 12. The shaft 32 and the handle 31 can be formed as an integral structure. The user can rotate the handle 31 to make the second end of the shaft 32 insert inward the main body 10 and abut the extending piece 122, thereby the extending piece 122 will abut the contact blade of the electrical plug.

A rotary logo 40 can be located on the surface of the main body 10 toward the rotary member 30. The rotary logo 40 can be a two-way or one-way arrow indicating the rotation of the handle 31. For example, when the user rotates the handle 31 in a clockwise direction of the arrow, the shaft 32 will gradually press against the extending piece 122, thereby pressing the contact blade of the electrical plug. And when the user rotates the handle 31 in a counterclockwise direction of the arrow, the shaft 32 will be gradually unscrewed and detached from the extending piece 122, and the electrical plug can be pulled out of the electrical socket 100.

The second end of the shaft 32 can include a threaded portion 33 for connecting to the main body 10. That is, the shaft 32 can be connected with the main body 10 by the threaded portion 33. The threaded engagement between the rotary member 30 and the main body 10 allows the rotary member 30 to rotate in one direction to drive the rotary member 30 into the main body 10, and rotate in the opposite direction to pull the rotary member 30 away from the main body 10.

The diameter of the second end of the shaft 32 is the same as the diameter of the first through hole 13. The diameter of the second end of the shaft 32 is larger than the diameter of the second through hole 21. And an inner wall of the first through hole 13 is threaded for coupling with the threaded portion 33. Thereby, the rotary member 30 can be fixed on the main body 10 by the cover member 20, preventing the rotary member 30 from detaching out of the main body 10.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. An electrical socket to receive an electrical plug having a plurality of contact blades, comprising:

a main body having a plurality of socket openings;

a rotary member rotatably connected to the main body, wherein an end of the rotary member extends into the main body; and a cover member detachably fixed to the main body for confining the rotary member to the main body, the rotary member is rotatable relative to the main body to prevent the plurality of contact blades from sliding out from one of the plurality of socket openings, wherein a plurality of conductor pieces corresponding to the plurality of socket openings are disposed in the main body, and when the rotary member is rotated, the end of the rotary member abuts one of the plurality of conductor pieces to prevent the plurality of contact blades from sliding out from the one of the plurality of conductor pieces when inserted in the plurality of socket openings.

2. The electrical socket of claim 1, wherein the one of the plurality of conductor pieces comprises an opening facing the rotary member, an extending piece movable in the opening, and a part of the extending piece has a concave shape.

3. The electrical socket of claim 2, wherein at least one first groove is disposed on a surface of the extending piece away from the rotary member.

4. The electrical socket of claim 1, wherein the cover member comprises an inserting part configured for inserting into and fixing the cover member to the main body.

5. The electrical socket of claim 4, wherein a flange is disposed on one end of the inserting part and configured for engaging the inserting part to the main body.

6. The electrical socket of claim 5, wherein the end of the inserting part further comprises a second groove configured for connecting the inserting part to the main body.

7. The electrical socket of claim 1, wherein the main body comprises a first through hole communicating with the one of the plurality of socket openings, and the cover member comprises a second through hole communicating with the first through hole to form a passage.

8. The electrical socket of claim 7, wherein a diameter of the first through hole is larger than a diameter of the second through hole.

9. The electrical socket of claim 7, wherein the rotary member comprises a shaft and a handle connected with the shaft, an end of the shaft inserts to the main body through the passage and abuts the one of the plurality of conductor pieces.

10. The electrical socket of claim 9, wherein the end of the shaft comprises a threaded portion for connecting to the main body, and an inner wall of the first through hole is threaded for coupling with the threaded portion of the shaft.

11. The electrical socket of claim 1, wherein the main body comprises three socket openings.

* * * * *